US005586354A

United States Patent [19]

Chi

[11] Patent Number: 5,586,354

[45] Date of Patent: Dec. 24, 1996

[54] METHOD FOR FORMING PATTERNS ON SHOE SOLE

[75] Inventor: Kuan-Jen Chi, Da Li, Taiwan

[73] Assignee: Kuan M. Chi, Da Li, Taiwan

[21] Appl. No.: 439,175

[22] Filed: May 11, 1995

[51] Int. Cl.[6] ..... A43D 8/24

[52] U.S. Cl. ..... 12/146 BR; 12/142 RS; 12/146 B

[58] Field of Search ..... 12/146 BR, 146 W, 12/142 P, 142 RS, 142 T, 146 B, 146 BP; 36/112, 30 R

[56] References Cited

U.S. PATENT DOCUMENTS

| | | | |
|---|---|---|---|
| 3,806,974 | 4/1974 | DiPaolo | 12/142 RS |
| 3,906,642 | 9/1975 | Cohen | 36/112 X |
| 4,026,044 | 5/1977 | Senter | 36/32 R X |
| 4,145,785 | 3/1979 | Lacey | 12/142 RS |
| 5,396,675 | 3/1995 | Vincent et al. | 12/142 P |

*Primary Examiner*—Ted Kavanaugh
*Attorney, Agent, or Firm*—Charles E. Baxley, Esq.

[57] ABSTRACT

A method for forming a pattern on a shoe sole includes preparing a film having a pattern attaching and transferring to an EVA material. The EVA material is then molded so as to allow infiltrating of the pattern in the EVA material and so as to form a shoe sole. The pattern is solidly formed on the outer peripheral surface of the shoe sole and will not be easily worn out. The shoe sole includes a cavity formed in the bottom portion for receiving an insert. The insert may be made of waste or recycled EVA materials.

1 Claim, 5 Drawing Sheets

METHOD FOR FORMING PATTERNS ON SHOE SOLE

BACKGROUND OF THE INVENTION

1. Field of the Invention

The present invention relates to a method, and more particularly to a method for forming patterns on the outer peripheral portion of the shoe soles.

2. Description of the Prior Art

Typical shoe soles, such as sandals and slippers are made of EVA materials (ethylene-vinyl acetate copolymer) which comprise various kinds of colors. However, no patterns may be formed on the outer peripheral surface of the shoe soles. Some people tried to print patterns on the outer surfaces of the shoes. However, the printed patterns may be easily worn out. Other people tried to adhered an outer cloth layer to the shoe soles, and the cloth layer includes a beautiful outer pattern thereon. However, the cloth layer may not be flatly and smoothly secured to the outer surface of the shoe soles due to the uneven outer surfaces of the shoe soles.

The present invention has arisen to mitigate and/or obviate the afore-described disadvantages of the conventional shoe soles.

SUMMARY OF THE INVENTION

The primary objective of the present invention is to provide a shoe sole which includes a pattern that may be solidly attached to the outer peripheral portion and will not be easily worn out.

In accordance with one aspect of the invention, there is provided a method for forming a pattern on a shoe sole comprising preparing an EVA material, preparing a film, providing a pattern on the film, attaching the film onto the EVA material so as to engage the pattern with the EVA material, disengaging the film from the EVA material so as to allow transferring of the pattern onto the EVA material, and molding the EVA material so as to allow infiltrating of the pattern in the EVA material and so as to form a shoe sole body. The shoe sole body includes an outer peripheral surface having the pattern provided therein and includes a bottom portion having a cavity formed therein, the shoe sole includes an insert for engaging in the cavity.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
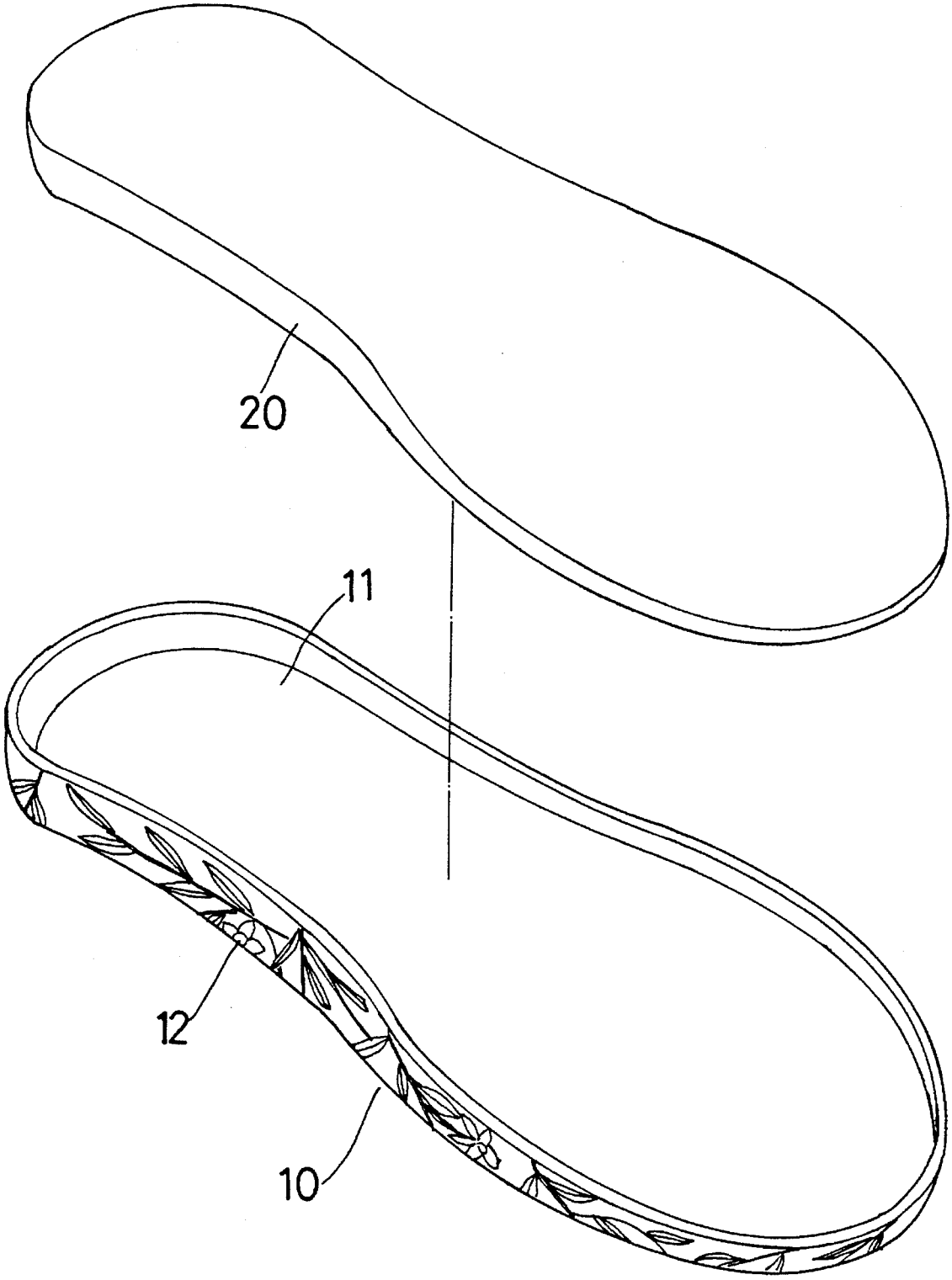
FIG. 1 is a bottom perspective view of a shoe sole in accordance with the present invention.
Figure 2:
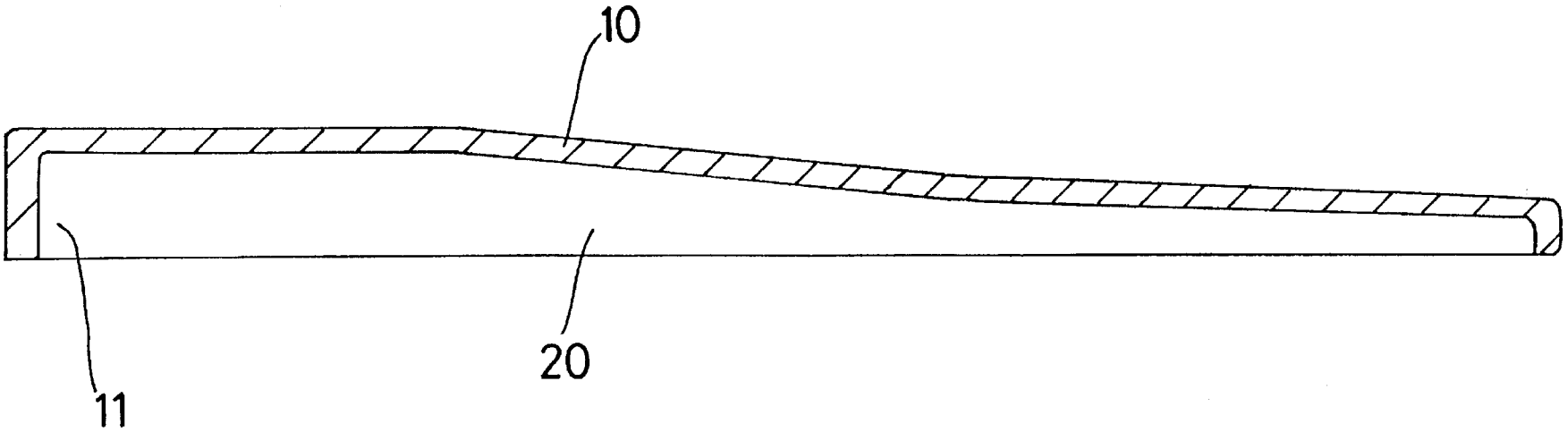
FIG. 2 is a cross sectional view of the shoe sole as shown in FIG. 1.

Referring to the drawings, and initially to FIGS. 1 and 2, a shoe sole in accordance with the present invention comprises a body 10 including a cavity formed in the bottom portion for engaging with an insert 20 which may be made of waste or recycled EVA materials. The body 10 and the insert 20 may be solidly secured together during molding processes or may be secured together by adhesive materials. The body 10 includes an outer peripheral surface having a pattern 12 provided therein.

Figure 3:
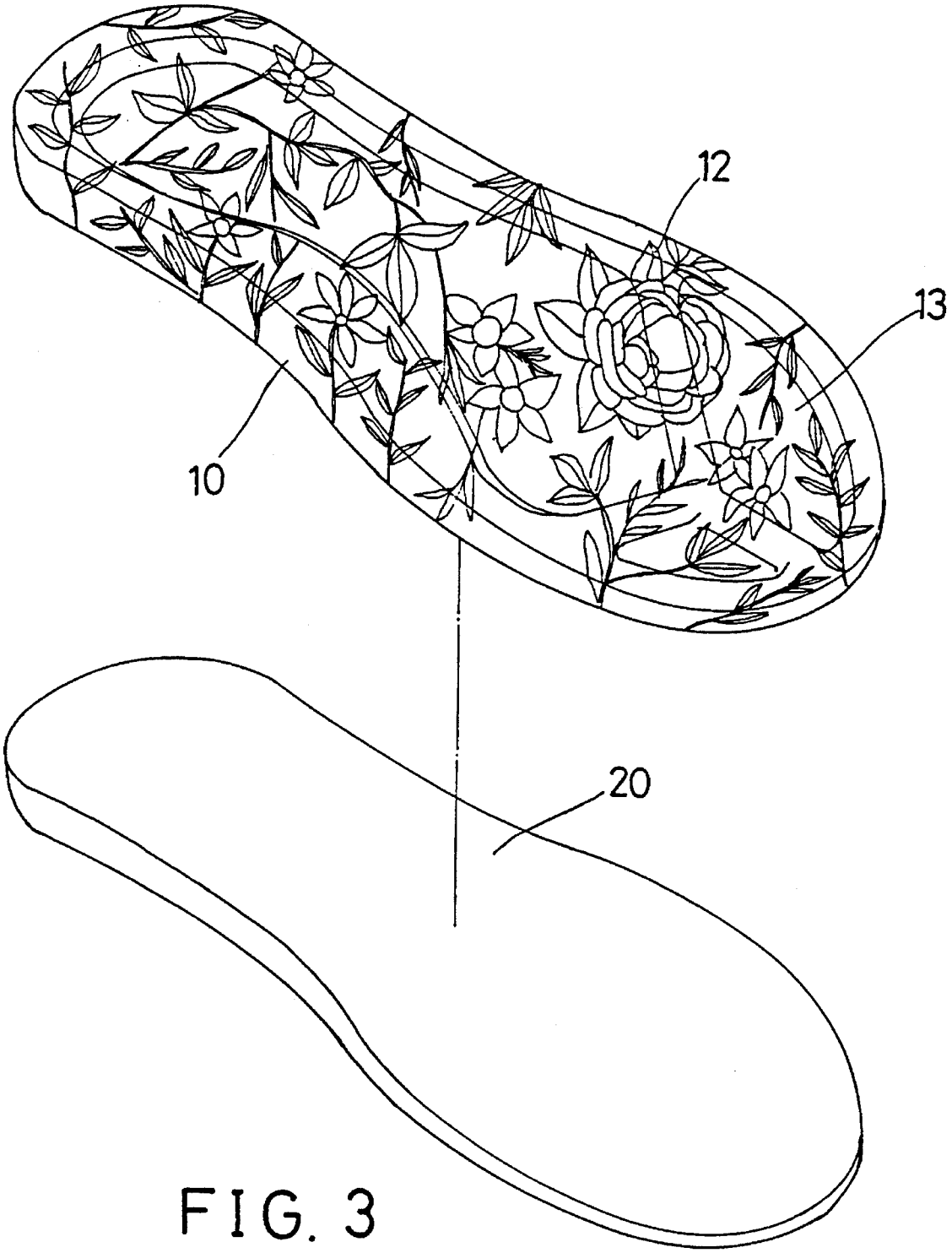
FIG. 3 is an upper perspective view illustrating the configuration of the upper surface of the shoe sole.
Figure 4:
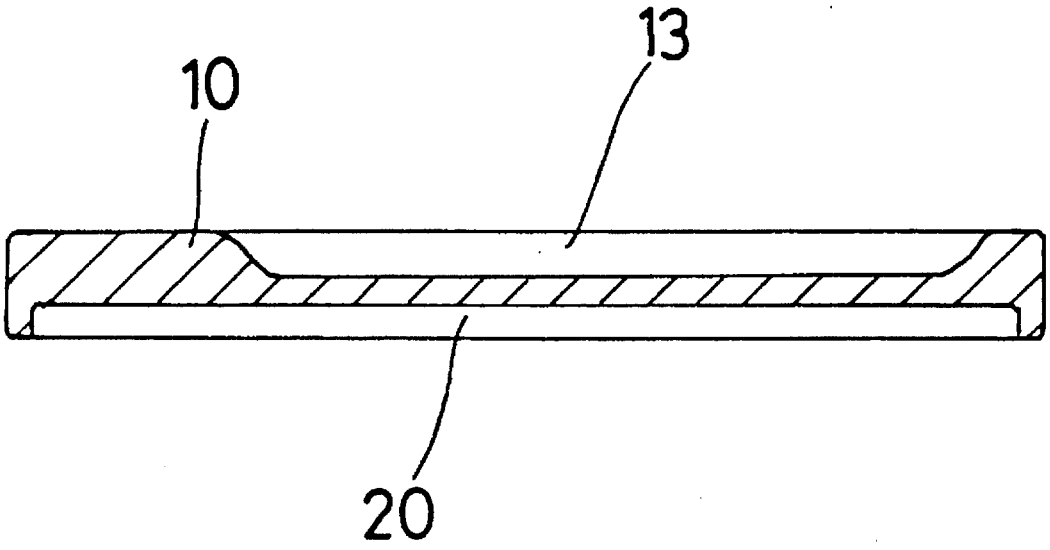
FIG. 4 is a cross sectional view of the shoe sole as shown in FIG. 3.

Referring next to FIGS. 3 and 4, the upper surface of the body 10 may include a recess 13 according to the shape of the foot of the human body such that the users may feel more comfortable.

Figure 5:
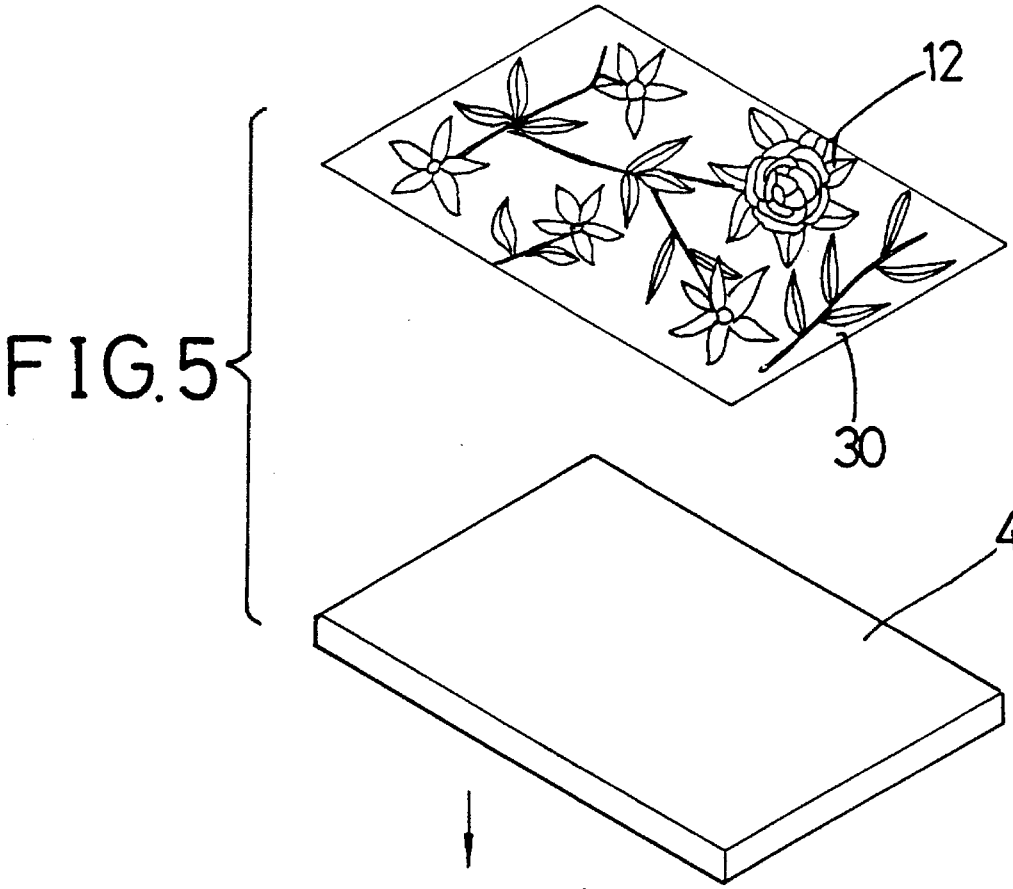
FIGS. 5, 6, 7 are schematic views illustrating the forming processes of the patterns on the shoe soles.
Figure 6:
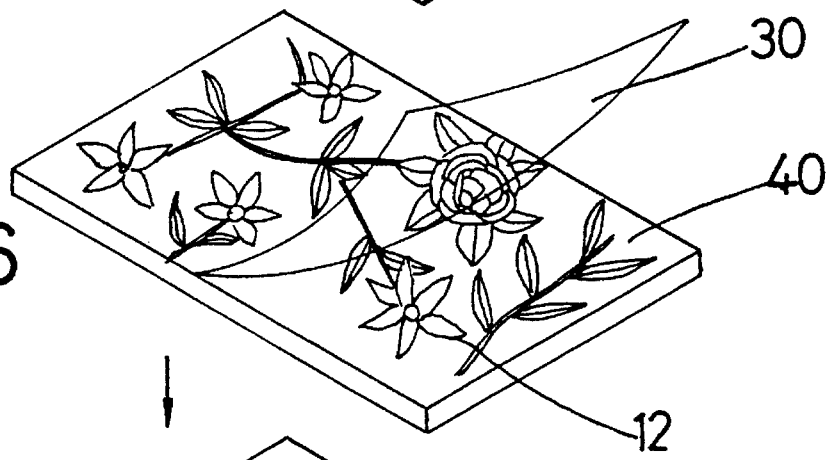
Figure 7:
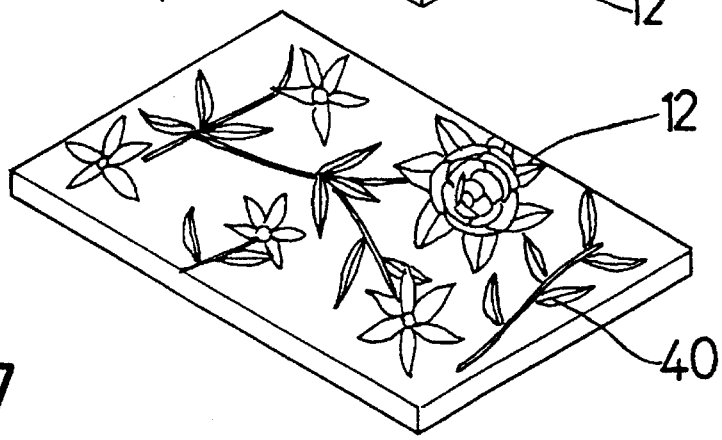

Referring next to FIGS. 5 to 7, illustrated is the processes for forming the patterns on the outer peripheral surface of the body 10. The present invention provides a film 30 having a pattern printed thereon. The film 20 can be made of such as vinyl or vinylidene chloride materials which can be adheres perfectly to the outer surface of an EVA material 40 without adhesive materials (FIG. 5) and which can be easily disengaged from the EVA material 40 (FIG. 6) so as to allow transferring of the patterns 12 onto the outer surface of the EVA material 40 (FIG. 7). The material 40 having a pattern 12 provided thereon is then subjected a conventional molding or hot-pressing process such that the pattern 12 may be solidly formed on the outer peripheral surface of the body 10. The conventional molding or hot-pressing process is well known in the art and will not be described in further details. The dye material of the pattern 12 may be infiltrated into the EVA material 40 during molding processes so as to be solidly attached to the EVA material 40 such that the pattern 12 may be solidly formed on the outer peripheral surface of the body 10.

Accordingly, various kinds of patterns may be solidly formed on the outer peripheral surface of the shoe soles by the method in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for forming a pattern on a shoe sole comprising:

preparing a material for forming said shoe sole, preparing a film, providing a pattern on said film, attaching said film onto said material so as to engage said pattern with said material, disengaging said film from said material so as to allow transferring of said pattern onto said material, and molding said material so as to allow infiltrating of said pattern in said material and so as to form a shoe sole body, wherein said shoe sole body includes an outer peripheral surface having said pattern provided therein and includes a bottom portion having a cavity formed therein, said shoe sole includes an insert for engaging in said cavity.

* * * * *